US010112770B2

(12) United States Patent
Bush

(10) Patent No.: US 10,112,770 B2
(45) Date of Patent: Oct. 30, 2018

(54) METHOD AND APPARATUS FOR SUPPORTING A FLOATING ROOF DISPOSED IN A STORAGE TANK

(71) Applicant: David Bush, Upland, CA (US)

(72) Inventor: David Bush, Upland, CA (US)

(73) Assignee: Delta P Technology International, LLC, Picayune, MS (US)

( * ) Notice: Subject to any disclaimer, the term of this patent is extended or adjusted under 35 U.S.C. 154(b) by 0 days.

(21) Appl. No.: 15/003,714

(22) Filed: Jan. 21, 2016

(65) Prior Publication Data

US 2016/0137405 A1 May 19, 2016

(51) Int. Cl.
*A47F 5/00* (2006.01)
*B65D 88/40* (2006.01)

(52) U.S. Cl.
CPC ..... *B65D 88/40* (2013.01)

(58) Field of Classification Search
CPC ..... B65D 88/40; B65D 88/34; B65D 88/36; E02D 29/0216; A47B 47/0016; A47B 91/005; F16B 7/044; F16B 7/185; F16B 2012/446; E04C 3/00; E04C 3/005
USPC ..... 405/273, 288; 52/127.1, 645–646, 52/653.1–653.2, 652.1; 248/354.5, 165, 248/346.3, 351, 678, 676; 182/156, 182/186.5, 190, 195, 206; 211/189, 195; 403/170–174, 176–177, 231; 16/42 T
See application file for complete search history.

(56) References Cited

U.S. PATENT DOCUMENTS

| | | | | |
|---|---|---|---|---|
| 1,989,624 | A | 1/1935 | Matter | |
| 2,847,755 | A | 8/1958 | Mummert et al. | |
| 4,497,597 | A * | 2/1985 | Chlumecky | E21D 15/02 299/11 |
| 4,630,550 | A * | 12/1986 | Weitzman | A47B 13/06 108/155 |
| 5,230,197 | A * | 7/1993 | Hart | E04B 1/19 52/638 |
| 5,430,989 | A * | 7/1995 | Jones | E04B 1/1903 403/171 |
| 5,611,187 | A * | 3/1997 | Jones | E04B 1/1903 403/122 |
| 6,321,503 | B1 * | 11/2001 | Warren | B64G 1/222 16/225 |
| 6,675,820 | B2 * | 1/2004 | Balan | A61H 3/008 135/67 |
| 2005/0022465 | A1 * | 2/2005 | Warren | B64G 1/222 52/653.2 |
| 2009/0025265 | A1 * | 1/2009 | Jedlicka | G09F 15/0062 40/610 |

(Continued)

OTHER PUBLICATIONS

International Search Report dated Aug. 10, 2017 for International Application PCT/US2017/033571.

*Primary Examiner* — Christopher Garft
(74) *Attorney, Agent, or Firm* — Holland & Hart, LLP

(57) ABSTRACT

Method and apparatus for cribbing a floating roof included in a storage tank whereby a first and a first opposite force are applied between a floor in the storage tank and an internal surface of the floating roof. An additional set of forces are also provided and are constrained according to the first and first opposite force, not only in magnitude, but in position. By constraining these forces to be applied orthogonally to the floating roof, horizontal shear forces can be resisted thus reducing the likelihood of failure of a cribbing unit.

20 Claims, 11 Drawing Sheets

(56) References Cited

U.S. PATENT DOCUMENTS

| | | | | |
|---|---|---|---|---|
| 2009/0321447 | A1 | 12/2009 | Imhof | |
| 2012/0180283 | A1 | 7/2012 | Erdmann et al. | |
| 2016/0137405 | A1 | 5/2016 | Bush | |
| 2016/0332810 | A1* | 11/2016 | Blinn ..... | B65D 88/34 |

* cited by examiner

PRIOR ART

METHOD AND APPARATUS FOR SUPPORTING A FLOATING ROOF DISPOSED IN A STORAGE TANK

BACKGROUND

There are many situations where there is a need to support a planar structure at variable distances in height to different distances to lower some height above the ground. One such application is that of a storage tank that includes a floating roof structure. This example use case can be best described with reference to FIG. 1. In FIG. 1, a floating roof structure 200 is typically used where a storage tank 205 is used to store a liquid, for example, jet fuel, gasoline, diesel, sour water and crude oil. Hence, it is common place for such a storage tank to include such a floating roof structure for environmental protection from flammable and hazardous vapor omissions to the environment. It should be appreciated that such a floating roof structure "floats" on top of the liquid product stored in the storage tank. As the level of the liquid product stored in the tank fluctuates, so does the height of the floating roof structure relative to a floor included in such a tank.

It is also a fact that an API 653 inspection is regulatory mandated for above ground storage tanks every ten years. The regulations require that all above ground storage tanks must be inspected and repaired to API 653 standards to verify the structural integrity of the tank shell, floating roof vapor control integrity and the tank floor. The aim of such inspections is to preclude seepage of hazardous, toxic and flammable liquids into the ground. Such seepage may cause environmental impact with wide reaching consequences, such as pollution of water tables. Because such inspections are known to reveal the type and extent of repairs needed to prevent leaks and other environmental cataclysms, it is unlikely that any of these inspection requirements will ever be abated. And, there are also occasions when the storage tank must be cleaned in preparation for storing a different liquid produce or a different class of a liquid product relative to a former substance previously stored in the tank. The floating roof must be held above the floor of the storage tank so that personnel can freely and safely conduct themselves during all such inspection, repair and cleaning activities.

FIG. 1 is a pictorial representation of a prior art apparatus for supporting a floating roof when a storage tank is devoid of liquid content. For years and years and years, the process of supporting a floating roof in the absence of a liquid product has been accomplished using substantially similar methods, each of which rely on the use of substantially identical support apparatus. As can be seen, the prior art has thus far relied on a basic support method using a "cribbing stack".

A cribbing stack 210 is typically made up of alternating layers of wood members, wherein each wood member from a preceding layer is set orthogonal to a subsequent layer. Hence, the height of the cribbing stack could be adjusted by simply stacking up more of such alternating layers of wooden members. Up until now, this prior art technique has been used without much deviation from this basic concept, that being the use of alternating layers of wooden members. It should be noted that these wooden members are someone akin to common railroad ties that are readily available throughout the world.

FIG. 1 also depicts one grave disadvantage associated with the use of a wooden, layered cribbing stack. It is well settled that a floating roof may exhibit rotational forces 215. When the floating roof is first lowered and substantially all product is removed from the tank, a collection of "legs", each of which penetrates the floating roof, are used to support the floating roof. These legs are very susceptible to horizontal forces that each leg experiences when the roof begins to rotate. This is true regardless of whether the storage tank is empty or of it has liquid content.

Wind can induces such rotational movement of the floating roof. There are methods to retard such rotational movement, but these methods often fail. One such method is based on the use of "anti-rotation wedges". These wedges are, by their very name, disposed between an outer perimeter of the floating roof and an internal wall of the storage tank. Such anti-rotational wedges are scarcely effective in the face of sever rotational movement of the floating roof.

It is when the floating roof exhibits rotational movement that personnel working in a storage tack are most vulnerable to injury and death. When a floating roof begins to rotate, it begins to apply a moment force onto each leg. Now, as the legs begin to fail, the plurality of cribbing stacks are intended to support the floating roof at some minimum height necessary to keep all personnel safe. Because the layers of a wooden cribbing stack are not fastened to each other, the cribbing stack simply falls apart when these horizontal forces go unopposed. The upper layers of the cribbing stack, from a force perspective, simply shear away from the lower layers of the cribbing stack. This, of course, results in the type of total failure of the support structure that has cost many lives and has resulted in extensive collateral, materiel damage and environmental impact.

There are also several environmental issues associated with the use of a wooden cribbing stack. In should be appreciated that the product ordinarily stored in a storage tank is a liquid and such liquids are typically hazardous materials. Such hazardous material may include petro chemical products, crude oil, flammable liquids and many other forms of extremely hazardous materials. Residual product in the storage tank will ordinarily permeate the wooden members. Hence, such contaminated wooden members cannot be reused and must be discarded as horizontal waste. And, each time a wooden member is discarded, new lumber must be used at the cost of many trees, harvested from our forests, further impacting global warming and greenhouse gas effects.

BRIEF DESCRIPTION OF THE DRAWINGS

Several alternative embodiments will hereinafter be described in conjunction with the appended drawings and figures, wherein like numerals denote like elements, and in which.

DETAILED DESCRIPTION

Figure 1:
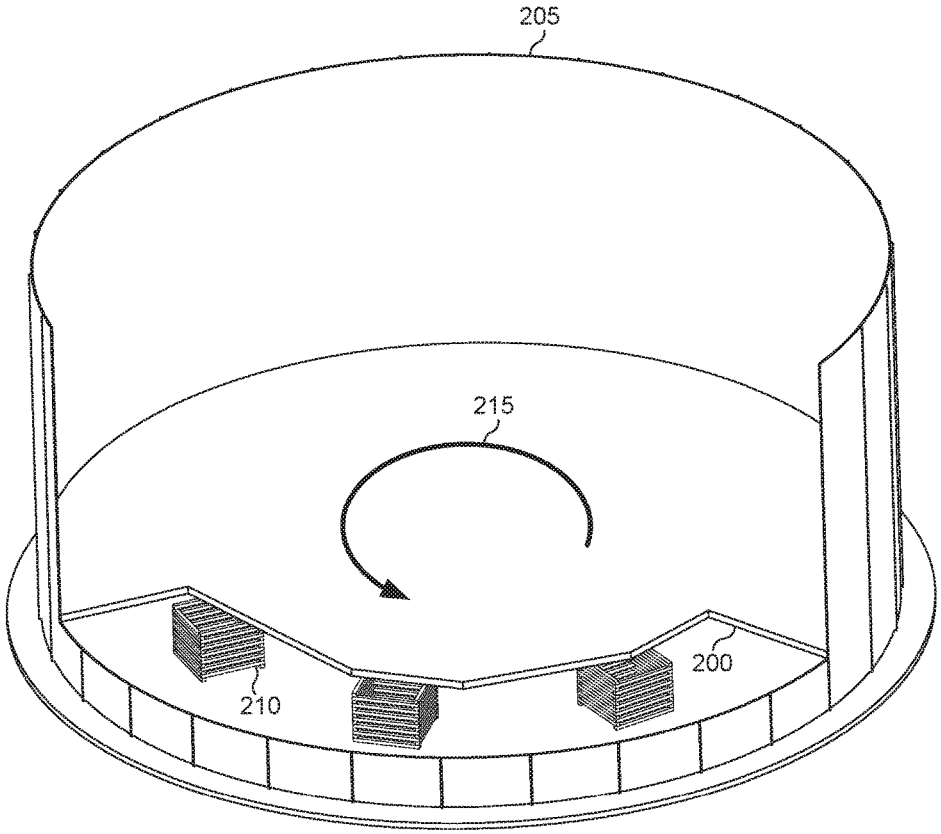
FIG. 1 is a pictorial representation of a prior art apparatus for supporting a floating roof when a storage tank is devoid of liquid content.
Figure 2:
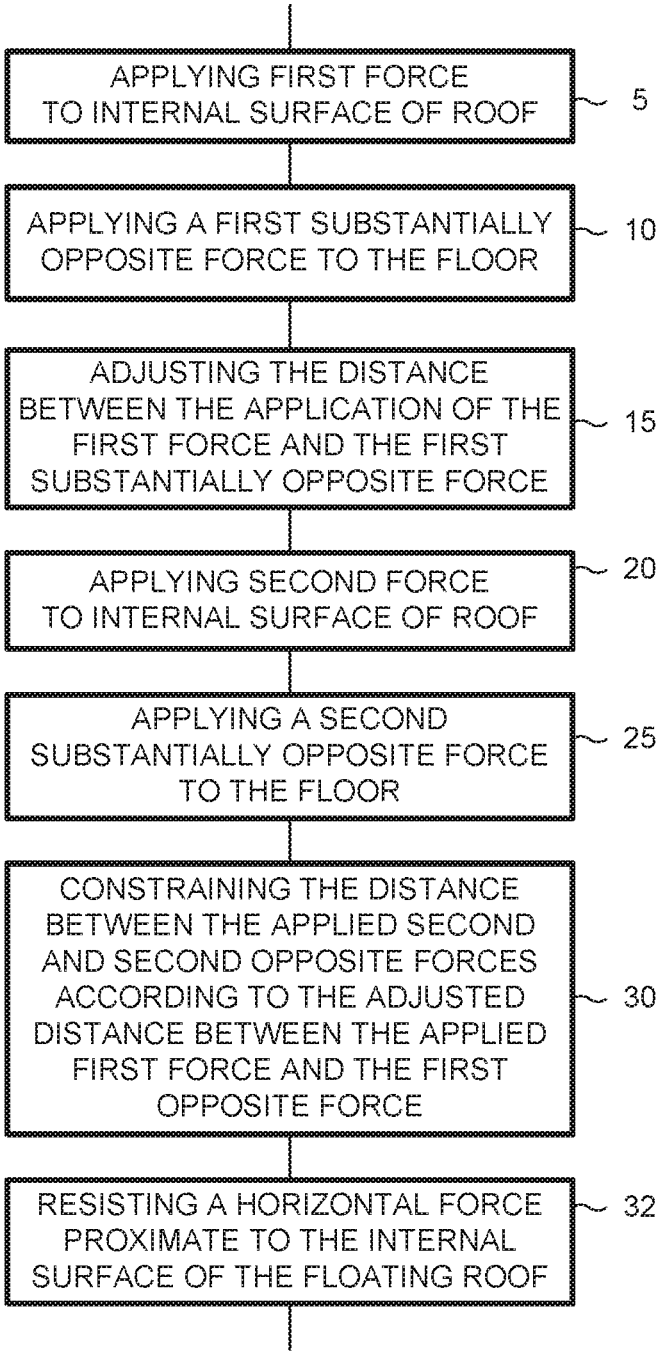
FIG. 2 is a flow diagram that depicts one example method for supporting a planar structure, for example a floating roof in a storage tank.

FIG. 2 is a flow diagram that depicts one example method for supporting a planar structure, for example a floating roof in a storage tank. According to this example method, a first force is applied to an internal surface of a floating roof (step 5). In a substantially contemporaneous step, a first substantially opposite force is applied to the floor (step 10). According to this example method, the distance between the applied first force and the applied first opposite force is adjusted (step 15) according to a particular height at which the floating roof is to be held above the floor. It should be appreciated that, at first blush, these two method steps can be accomplished by simply placing a load bearing member, operating in compression, between the floating roof and the floor. In such a simple method, a load bearing member is simply used to the prop up the roof in order to hold it at a pre-established height above the floor. But, even in this simple embodiment, there is nothing provided to act against horizontal forces imparted to a cribbing stack when the floating roof rotates.

The present method goes further by requiring that a second force is to be applied to the internal surface of the floating roof (step 20) and a substantially equal, but opposite force is applied to the floor (step 25). In one alternative example method, the cribbing unit further causes the distance between the first and the first opposite force and the second and the second opposite force at distances substantially equal to each other (step 30). A last step is then to resist horizontal forces applied proximate to the first and second forces (step 32). The present method, when applied, resists horizontal shear forces imparted upon a cribbing unit by a rotational movement of the floating roof.

Figure 3:
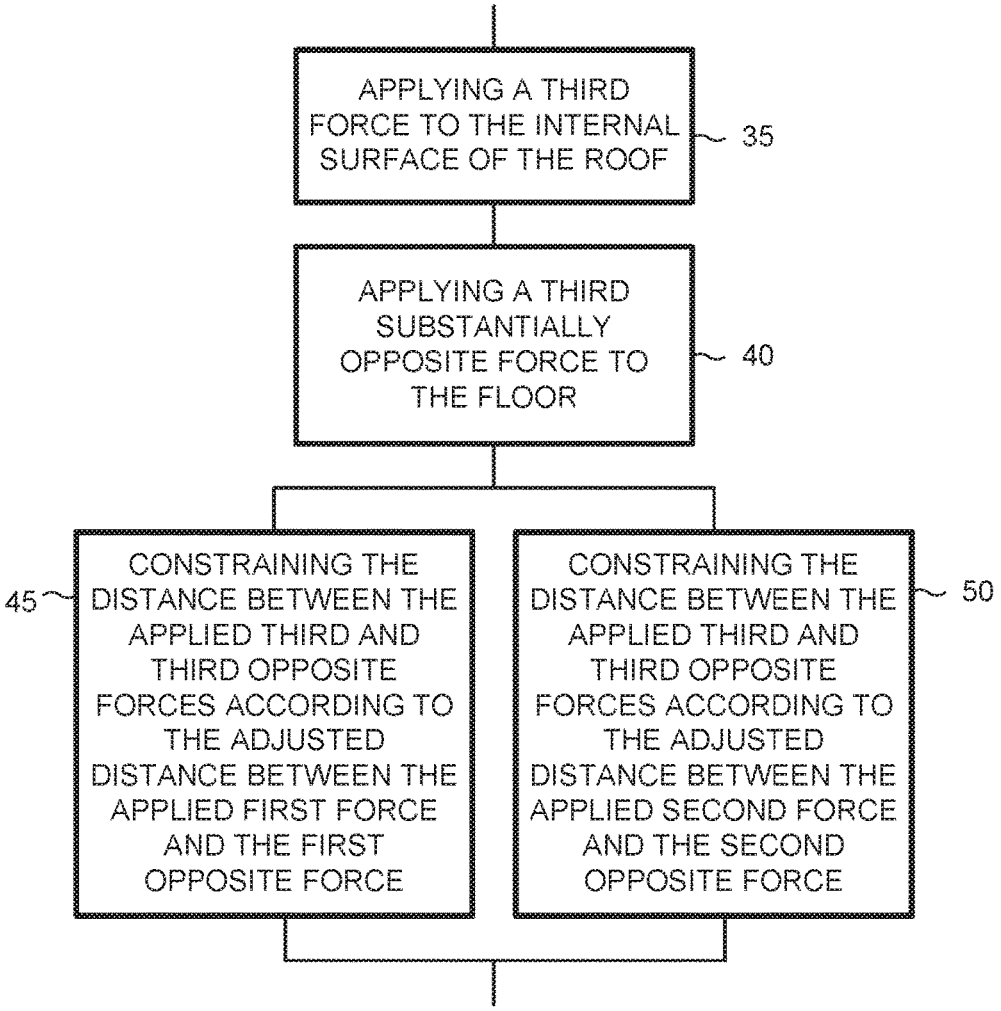
FIG. 3 is a flow diagram that depicts an alternative example method that relies upon the application of a third set of forces.

FIG. 3 is a flow diagram that depicts an alternative example method that relies upon the application of a third set of forces. In this alternative method, a third force is applied to the internal surface of the roof (step 35) along with a third equal, but substantially opposite third force is applied to the floor of the storage tank (step 40). In one alternative example method, the distance between the third and third substantial equal but opposite force is constrained according to an adjusted distance between the first and first opposite force (step 45). In yet another alternative example method, the distance between the third and third substantial equal but opposite force is constrained according to an adjusted distance between the second and second opposite force (step 50).

Figure 4:
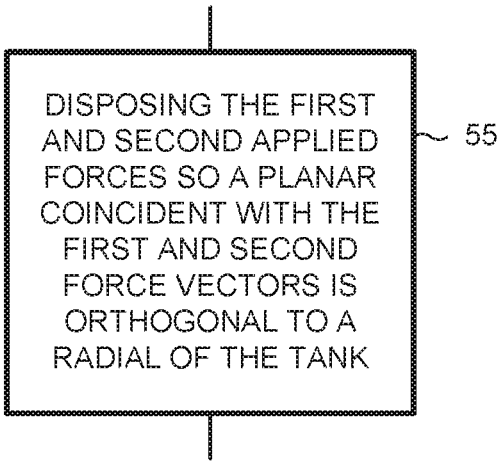
FIG. 4 is a flow diagram that depicts an alternative example method for maximizing to amount of horizontal force that a cribbing unit will resist.
Figure 12:
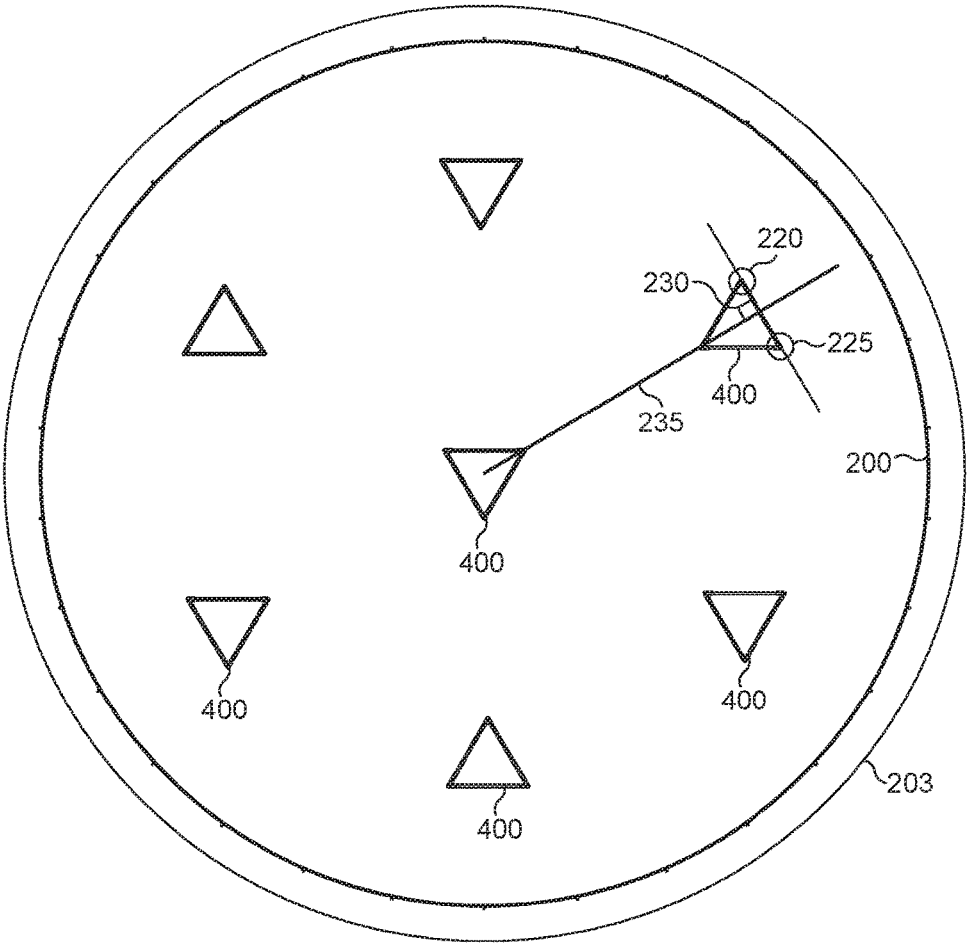
FIG. 12 depicts a typical layout of cribbing units under a floating roof.

FIG. 4 is a flow diagram that depicts an alternative example method for maximizing to amount of horizontal force that a cribbing unit will resist. FIG. 12 is a plan view of placement of a plurality of cribbing units according to this alternative example method. As can be seen in FIG. 12, application of the first force 220 and the second force 225 is accomplished by setting a line segment between the first force 220 and the second force 225 to be substantially orthogonal 230 to a radial line 235. It should be appreciated that, by setting these two forces substantially orthogonal to the radial line 235 (step 55), this alternative method further resists application of a horizontal force applied to a cribbing unit by a rotating floating roof.

Figure 5:
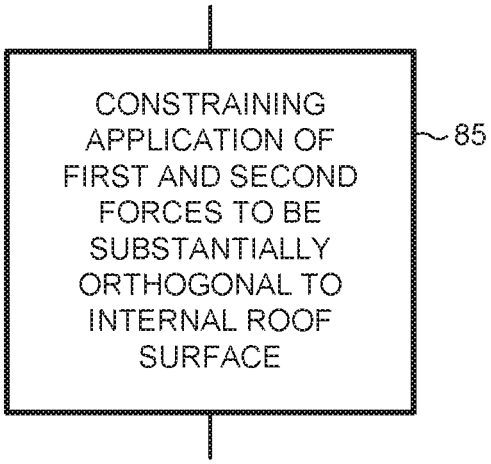
FIG. 5 is a flow diagram that depicts one alternative example method for resisting horizontal forces by applying the first and second forces orthogonally to the floating roof.

FIG. 5 is a flow diagram that depicts one alternative example method for resisting horizontal forces by applying the first and second forces orthogonally to the floating roof. One aspect of resisting horizontal movement that may be imparted upon a cribbing unit by a rotating floating roof provides for applying the first and second forces in a direction substantially orthogonal to a plane coincident with the planer of the floating roof.

Again in FIG. 2, method step 32, one possible embodiment of the present illustrative method includes members to continuously maintain such an orthogonal application of the first and second forces. It can thus be appreciated that, by so constraining the application of the first and second forces to the internal surface of the roof, application of the first opposite but equal first force and the second opposite, but equal second force are also constrained in an orthogonal application to the floor of the tank. Accordingly, such constraint of the first and first but opposite force and the second and the second but opposite force will result in resisting a horizontal force imparted upon a cribbing unit by the floating roof as the floating roof exhibits rotation.

Figure 6:
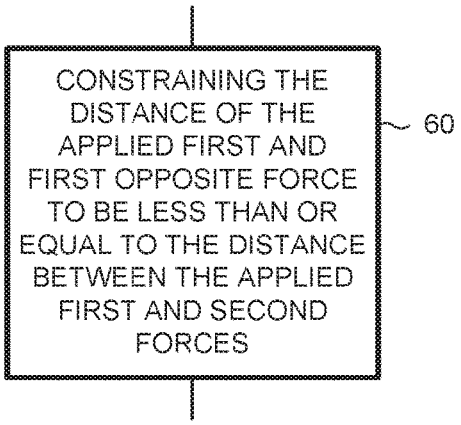
FIG. 6 is a flow diagram that depicts one alternative example method that reduces the likelihood of "tip over" by a cribbing unit.

FIG. 6 is a flow diagram that depicts one alternative example method that reduces the likelihood of "tip over" by a cribbing unit. It should be appreciated that, according to one illustrative use case, a cribbing unit may in fact tip over if the distance between application of the first and second forces is smaller than the application of the first and first substantially opposite first force. Accordingly, this example method provides that the distance between application of the first and first opposite force should be held less than the distance between application of the first and second forces (step 60). Hence, a cribbing unit that exhibits such a constraining characteristic is less likely to tip over when subjected to horizontal forces.

Figure 7:
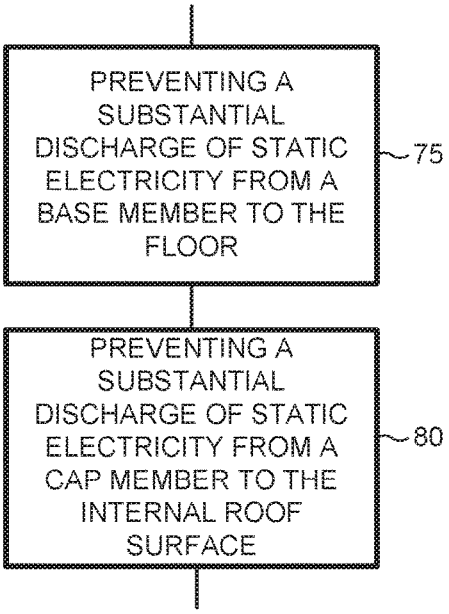
FIG. 7 is a flow diagram that depicts one alternative method useful where product formerly stored in a storage tank is volatile.

FIG. 7 is a flow diagram that depicts one alternative method useful where product formerly stored in a storage tank is volatile. It should be appreciated that, according to essentially all prior art, cribbing stacks were utilized and that these cribbing stacks were comprised of wood members. It should also be appreciated that where there was volatile product stored in a storage tank, it is imperative not to introduce an ignition source into the tank volume. Since the prior art cribbing stacks were made of wood, there was little likelihood that these wooden members would accept a static charge. With the new cribbing units introduced here, there is a potential for electrical discharge because the cribbing units are made of various metals.

Accordingly, in this alternative method, it becomes necessary to prevent, to as a great extent as possible, the amount of static electrical charge that can be accepted by the cribbing unit. As such, this alternative example method provides for preventing a substantial discharge of static electricity from a base member, included in a cribbing unit, to the tank floor(step 75). This alternative example embodiment further includes a step for preventing a substantial discharge of static electricity from a cap member, also included in one alternative embodiment of a cribbing unit, to the internal surface of the floating roof (step 80). In should be appreciated that, according to one alternative embodiment, these method steps are accomplished by using a braided grounding element to make electrical contact from the cribbing unit to at least one of the tank floor and the internal surface of the floating roof.

Figure 8:
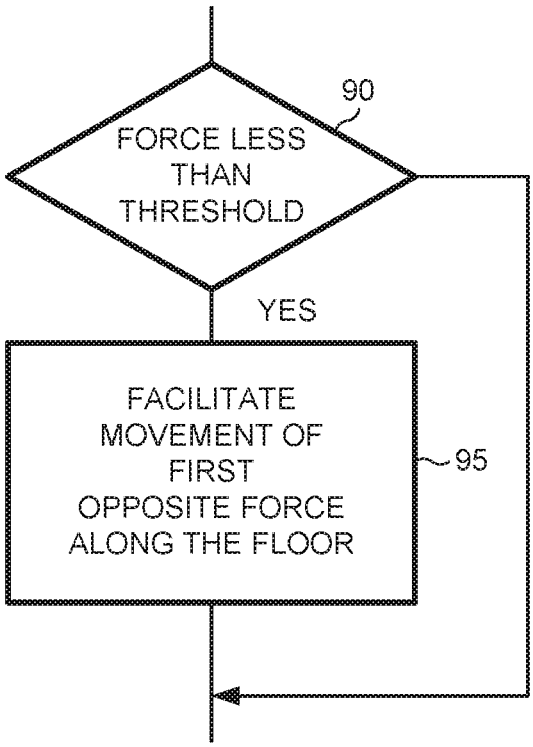
FIG. 8 is flow diagram that depicts an alternative example method that provides for easier movement of a cribbing unit when it is disposed in a storage tank.

FIG. 8 is flow diagram that depicts an alternative example method that provides for easier movement of a cribbing unit when it is disposed in a storage tank. Prior art methods for cribbing relied on wooden members that were stacked together to form a cribbing stack. It should be appreciated that any relocation of the cribbing stack would require extensive labor in order to tear down the cribbing stack and reassemble it in another location in the storage tank. Hence, the weight of the cribbing stack, per se, was not an issue for relocating the cribbing stack. The individual members of the cribbing stack could easily be moved by repair and support technicians and reassembled into a cribbing stack in a new location.

With the advent of the cribbing units now available, movement of the cribbing units becomes problematic because the cribbing units, which are ideally moved as whole units, are heavy and require great physical effort in order to lift and move them to a new location. Of course, a cribbing unit could be torn down into its constituent components, but that again leaves personnel vulnerable to failure of the legs provided by the floating roof to support the floating roof when the tank is devoid of product. Hence, it is preferable to move the cribbing units "intact" from one location to another within the volume of the storage tank. In this alternative example method, movement of the first force is facilitated (step 95) when the force applied to the floating roof is less than a pre-established threshold (step 90).

Figure 9:
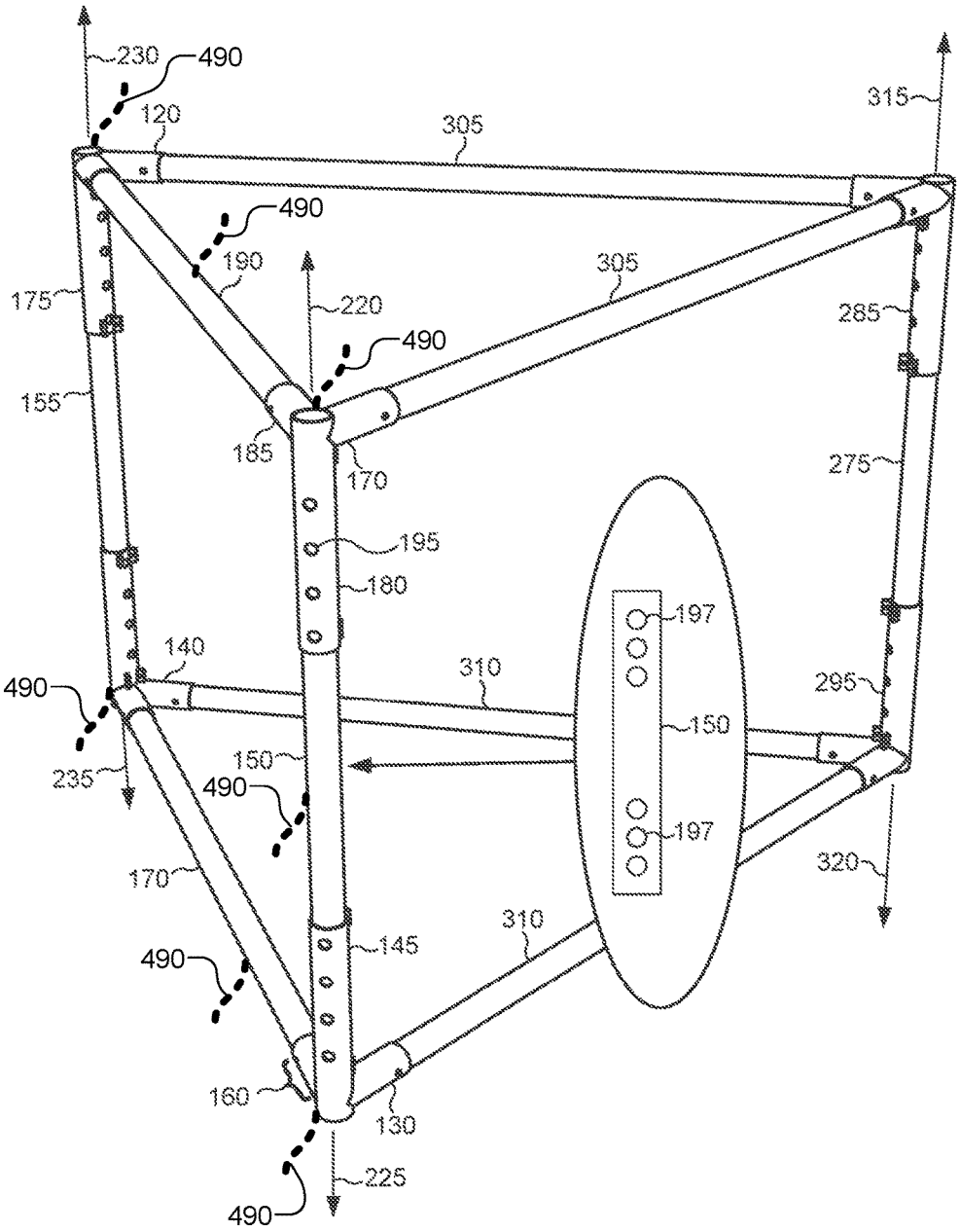
FIG. 9 is a pictorial diagram of one example embodiment of a cribbing unit that adheres to the method and techniques for cribbing as described thus far.

FIG. 9 is a pictorial diagram of one example embodiment of a cribbing unit that adheres to the method and techniques for cribbing as described thus far. It should be appreciated that the new cribbing unit is typically described as a system for cribbing because various components in the system may or may not be utilized depending on specific use cases. Accordingly, even though most of this description described a "cribbing unit", the claims appended hereto refer to a system for cribbing because of the modular nature of the cribbing system.

In this example embodiment, a cribbing unit comprises first and second base members (130 and 140). Each such base member includes a receptacle 145 for a vertical riser 150. This embodiment further includes a first and second vertical riser (150 and 155). It should be appreciated that each of said vertical risers are tubular in nature and are accepted by the receptacles 145 included in each of the first and second base members (130 and 140). The first vertical riser 150 is "pinned" into position so as to constrain the distance between a first force 220 and a first opposite force 225. Likewise, the second vertical riser 155 is pinned into position so as to constrain the distance between a second force 230 and a second opposite force 235.

In this example embodiment, the first and second base members (130 and 140) also include a receptacle for a horizontal base span 170. The base span 170 is also included in this example embodiment and is received by the receptacles included in the first and second base members (130 and 140). Typically, the horizontal base span is "pinned" into position so that it constrains the distance between a first opposite force 225 and a second opposite force 235 as applied to the internal surface of the floating roof.

This example embodiment also includes a first cap member 170 and second cap member 175. Each of said cap members also includes a receptacle for a vertical riser 180 and a receptacle for a horizontal cap span 185. In application, each cap member receives a vertical riser (150 and 155) and a horizontal cap span 190. It should be appreciated that the horizontal cap span is pinned into position so as to restrain the distance between the first force 220 and the second force 230. Likewise, the vertical risers (150 and 155) are also pinned into the cap members (170 and 175). In application of the present apparatus, the vertical risers 150 and 155 are pinned at substantially similar locations so that the distance between the application of the second force 230 and the second opposite force 235 is constrained to be substantially equal to the distance between the first force 220 and the first opposite force 225.

FIG. 9 also depicts an alternative embodiment where the height of the cribbing unit is adjustable. In order to achieve adjustment, the receptacles for receiving the risers 180 included in each of the base members and cap members includes restraint positions comprising a hole 195 that penetrates both walls of a tubular receptacle. The risers (150 and 155) also include corresponding holes 197 through a first and second wall of a tubular riser. In this alternative embodiment, holes are provided at one or at both ends of the risers (150 and 155).

FIG. 9 presents yet another alternative embodiment where three forces are used in support of a floating roof. In this alternative embodiment, a third vertical riser 275 is included in the cribbing unit. This third vertical riser 275 is used in conjunction with a third cap member 285 and a third base member 295. Two additional cap spans 305 and two additional base spans 310 are used to constrain position and application of a third force 315 and a third opposite force 320 relative to at least one of the position of the first force 220 and the position of the second force 230. In this alternative embodiment, the height of the cribbing unit at the third riser is set to be substantially equal to the height of the cribbing unit at the first 220 or second 230 forces.

FIG. 9 also shows a cribbing unit that resists "tip-over". In this alternative embodiment, the length of the horizontal cap span 190 and the horizontal base span 170 is greater than the overall height of the cribbing unit 400 itself, which is driven by the length of the vertical risers. Since the cribbing unit 400 is wider than it is tall, it resists tip-over when a horizontal force is applied proximate to the application of any of the first 220 and second 230 forces.

Figure 10:
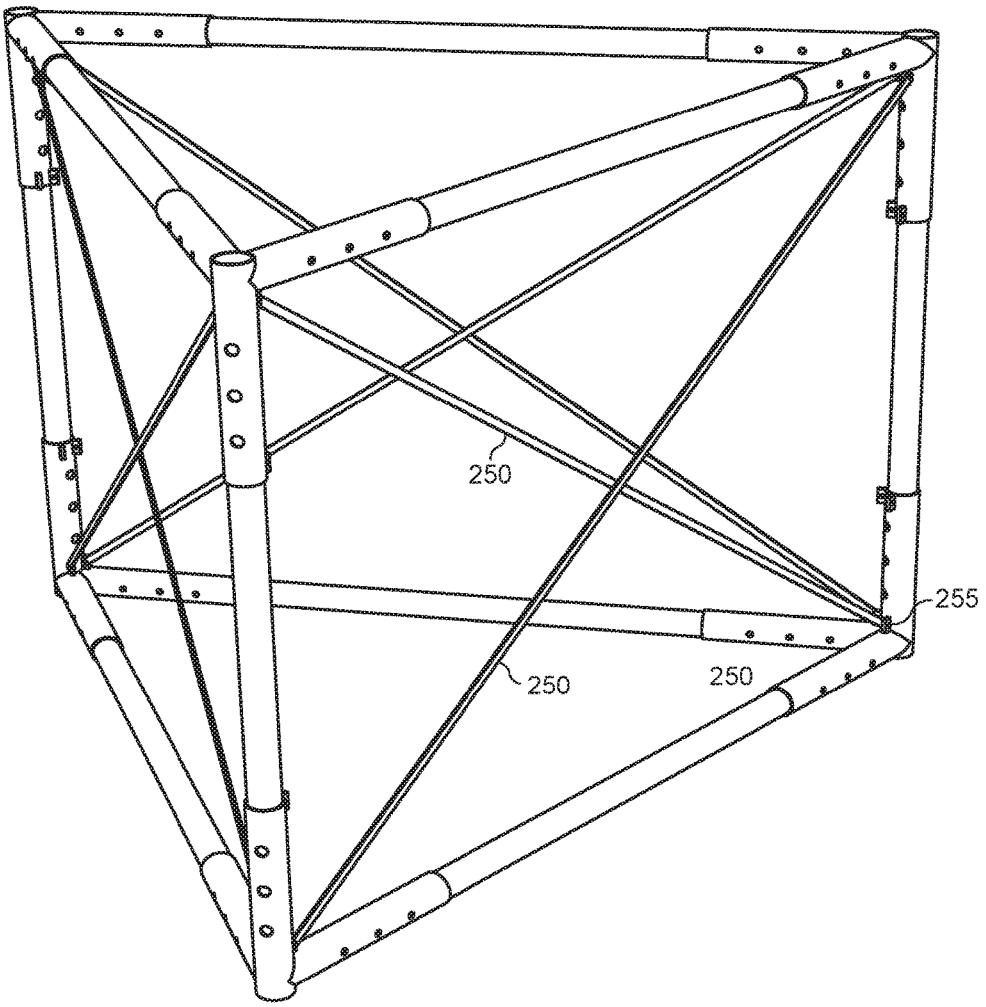
FIG. 10 is a pictorial diagram of a cribbing unit that includes enhanced horizontal resistance.

FIG. 10 is a pictorial diagram of a cribbing unit that includes enhanced horizontal resistance. In this alternative embodiment, a cribbing unit further includes diagonal cross-braces 250. In this alternative embodiment, across brace is attached at its ends to a cross-brace attachment included in a cap member and to across-brace attachment included in abuse member wherein the cap and base members are diagonal to each other. It can be appreciated that these cross-braces 250 operate in tension when the cribbing unit experiences horizontal force.

Figure 11:
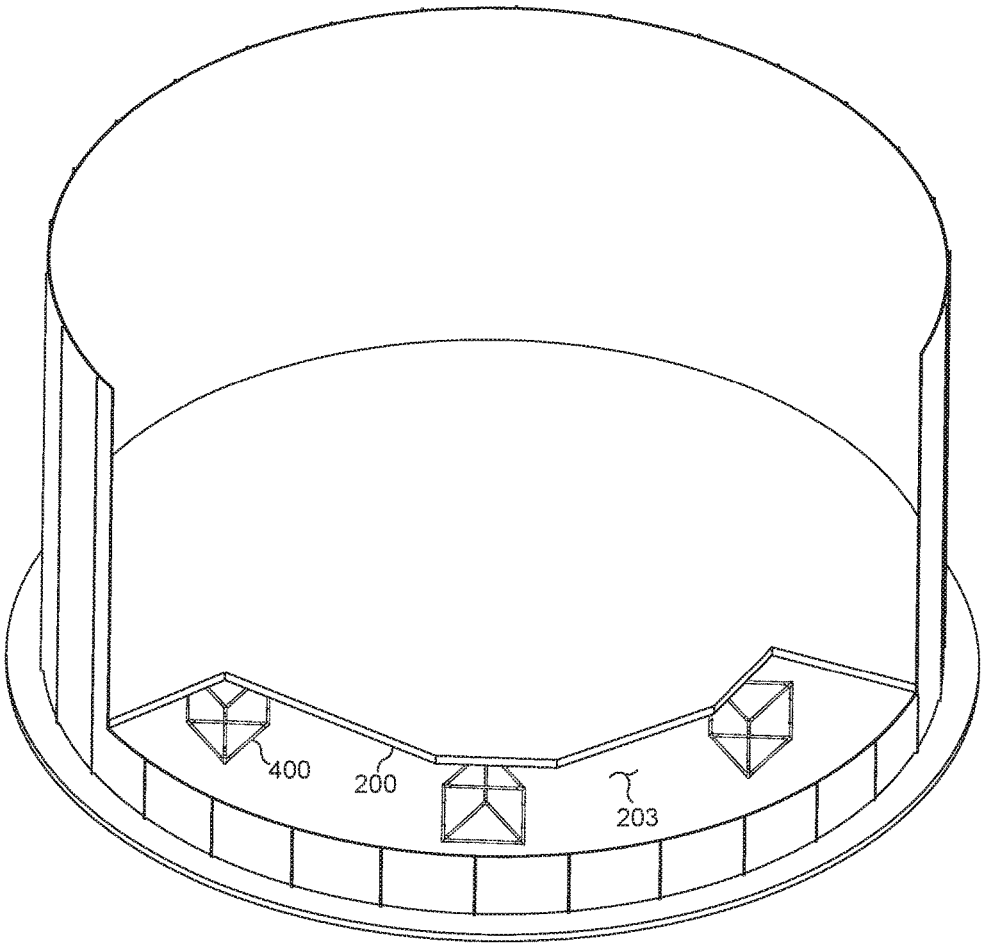
FIG. 11 is a cut-away pictorial of a storage tank wherein the floating roof is supported by a plurality of new cribbing units.

FIG. 11 is a cut-away pictorial of a storage tank wherein the floating roof is supported by a plurality of new cribbing units. This figure depicts a storage tank 205 that includes a metal floor 203. There is a plurality of cribbing units 400 depicted where the cribbing units are arranged to support a floating roof 200 in the event the legs ordinarily used to support the floating roof 200 should fail.

It can be appreciated that, according to an alternative embodiment, the new cribbing units are constructed from tubular metal. Various metals can be used to fashion the new cribbing units. For example, one alternative embodiment provides for constructing the new cribbing units from at least one of a titanium and a titanium alloy. In another example embodiment, the new cribbing units are constructed from steel. The advantages of constructing the new cribbing unit from metal are multifold. First, a metal cribbing units is able to bear much greater compression loads than the wooden cribbing stack of prior art. As such, a fewer number of the new cribbing units are needed to support a floating roof.

From an environment perspective, a cribbing system constructed from metal does not need to be discarded as does a wooden cribbing stack of prior art. A metal used to construct the cribbing units will not absorb hazardous materials and can be easily cleaned while the floor of the storage tank is being cleaned. All hazardous material can be contained in such cleaning process. And, because the cribbing system herein described can be reused, our forests need not lay down their lives to provide new cribbing material.

FIG. 12 depicts a typical layout of cribbing units under a floating roof. It can be appreciated that cribbing units no longer need to be stacked in a particular place. A much safer method of placing the new cribbing unit is to assemble a cribbing unit and glide it into position.

Figure 13:
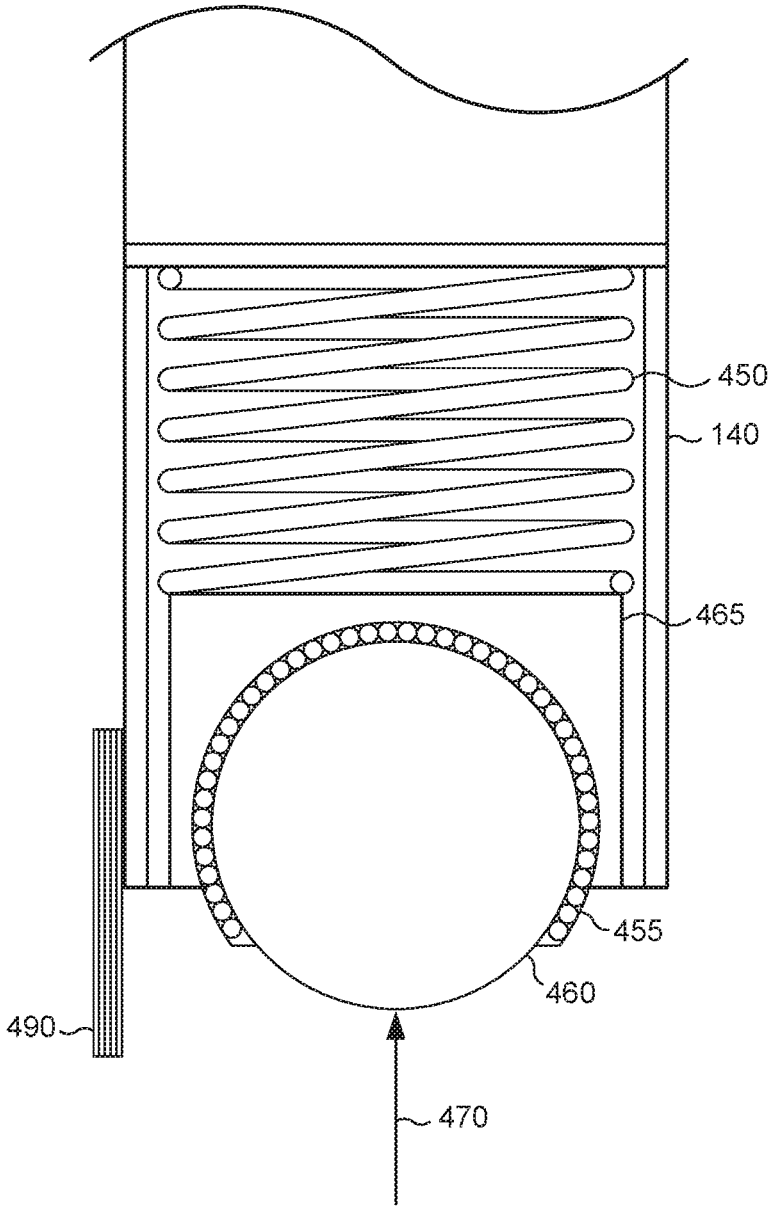
FIG. 13 is a cross section view of a base member that includes a roller transfer.

FIG. 13 is a cross section view of a base member that includes a roller transfer. In order to facilitate movement of a cribbing unit along the tank floor, one alternative embodiment of a cribbing unit includes a spring loaded roller transfer 465. This alternative embodiment also includes a spring 450 that is selected to cause the roller transfer unit 465 to extend downward against a floor surface. When a force 470 exceeds the spring force, then the roller transfer unit 465 retracts back into the receptacle 145 for the vertical riser, except that the roller transfer unit 465 retracts back into the receptacle 145 at an end opposite the vertical riser. When the spring 450 is not compressed, the roller transfer unit 465 makes contact with the floor and enables easy movement of the cribbing unit along the floor. When the load bearing down on the cribbing units is great enough so as to compress the spring, then the roller transfer retracts into the base member and the load is supported by the outer perimeter of the base member 145.

FIG. 13 also depicts that a base member, or a cap member, further includes a grounding element. The grounding element 490 makes contact with either the floor or the internal surface of the floating roof so that the voltage on the cribbing unit, which is entirely conductive, remains at ground. In one example embodiment, the grounding element 490 comprises a broom-like structure made of braided wire.

While the present method and apparatus has been described in terms of several alternative and exemplary embodiments, it is contemplated that alternatives, modifications, permutations, and equivalents thereof will become apparent to those skilled in the art upon a reading of the specification and study of the drawings. It is therefore intended that the true spirit and scope of the claims appended hereto include all such alternatives, modifications, permutations, and equivalents.

What is claimed is:

1. A cribbing system, comprising:

a first vertical riser;

a second vertical riser;

a first horizontal base span;

a first horizontal cap span;

a first base member having a first vertical base receptacle and a first horizontal base receptacle, wherein the first vertical base receptacle is configured to selectively receive the first vertical riser and the first horizontal base receptacle is configured to selectively receive the first horizontal base span;

a second base member having a second vertical base receptacle and a second horizontal base receptacle, wherein the second vertical base receptacle is configured to selectively receive the second vertical riser and the second horizontal base receptacle is configured to selectively receive the first horizontal base span;

a first cap member having a first vertical cap receptacle and a first horizontal cap receptacle, wherein the first vertical cap receptacle is configured to selectively receive the first vertical riser and the first horizontal cap receptacle is configured to selectively receive the first horizontal cap span;

a second cap member having a second vertical cap receptacle and a second horizontal cap receptacle, wherein the second vertical cap receptacle is configured to selectively receive the second vertical riser and the second horizontal cap receptacle is configured to selectively receive the first horizontal cap span; and a grounding strap having a first end and a second end, wherein the first end of the grounding strap is coupled to one or more of the first vertical riser, second vertical riser, first horizontal base span, first horizontal cap span, first base member, second base member, first cap member, and second cap member, and wherein the first vertical riser, second vertical riser, first horizontal base span, first horizontal cap span, first base member, second base member, first cap member, and second cap member are electrically conductive.

2. The cribbing system of claim 1, further comprising:

a first cross-brace coupled to the first base member and the second cap member; and a second cross-brace coupled to the second base member and the first cap member.

3. The cribbing system of claim 1, wherein the first base member comprises a first base roller receptacle positioned generally opposite to the first vertical base receptacle, wherein the first base roller receptacle comprises a first roller transfer unit disposed therein.

4. The cribbing system of claim 3, wherein the first roller transfer unit comprises a ball and a spring, wherein the spring biases the ball in a first direction generally opposite to the first vertical base receptacle.

5. The cribbing system of claim 4, wherein the spring is configured to retract the ball into the first base roller receptacle when a force exerted substantially in the first direction exceeds a pre-established threshold.

6. The cribbing system of claim 3, wherein the second base member comprises a second base roller receptacle positioned generally opposite to the second vertical base receptacle, wherein the second base roller receptacle comprises a second roller transfer unit disposed therein.

7. The cribbing system of claim 1, wherein the first vertical riser and second vertical riser have a first length, and wherein the first horizontal base span and first horizontal cap span have a second length, wherein the first length is less than the second length.

8. The cribbing system of claim 7, wherein each of the first vertical riser, second vertical riser, first base member, second base member, first cap member, and second cap member comprise a plurality of holes therein, and wherein the first length is adjustable via a selective pinning between the respective holes in the first vertical riser, second vertical riser, first base member, second base member, first cap member, and second cap member.

9. The cribbing system of claim 8, wherein the first vertical riser and second vertical riser are tubular in cross-section, wherein the plurality of holes extend through said first vertical riser and second vertical riser.

10. The cribbing system of claim 1, further comprising:
a third vertical riser;
a second horizontal base span;
a second horizontal cap span;
a third horizontal base span;
a third horizontal cap span;
a third base member; and
a third cap member,
wherein the first base member further comprises a first angled horizontal base receptacle set at an angle relative to the first horizontal base receptacle and configured to selectively receive the second horizontal base span,
wherein the first cap member further comprises a first angled horizontal cap receptacle set at an angle relative to the first horizontal cap receptacle and configured to selectively receive the second horizontal cap span,
wherein the second base member further comprises a second angled horizontal base receptacle set at an angle relative to the second horizontal base receptacle and configured to selectively receive the third horizontal base span,
wherein the second cap member further comprises a second angled horizontal cap receptacle set at an angle relative to the second horizontal cap receptacle and configured to selectively receive the third horizontal cap span,
wherein the third base member has a third vertical base receptacle, a third horizontal base receptacle, and a third angled horizontal base receptacle set at an angle relative to the third horizontal base receptacle, wherein the third vertical base receptacle is configured to selectively receive the third vertical riser, wherein the third horizontal base receptacle is configured to selectively receive the second horizontal base span, and wherein the third angled horizontal base receptacle is configured to selectively receive the third horizontal base span,
wherein the third cap member has a third vertical cap receptacle, a third horizontal cap receptacle, and a third angled horizontal cap receptacle set at an angle relative to the third horizontal cap receptacle, wherein the third vertical cap receptacle is configured to selectively receive the third vertical riser, wherein the third horizontal cap receptacle is configured to selectively receive the second horizontal cap span, and wherein the third angled horizontal cap receptacle is configured to selectively receive the third horizontal base span.

11. The cribbing system of claim 1, wherein the second end of the grounding strap is configured to be electrically connected to a surface of a tank.

12. The cribbing system of claim 1, wherein the grounding strap comprises a braided wire.

13. The cribbing system of claim 12, wherein the second end of the grounding strap comprises a broom-like structure defined by the braided wire.

14. The cribbing system of claim 1, wherein the second end of the grounding strap is configured to be electrically connected to a surface of a tank.

15. The cribbing system of claim 14, wherein the surface of the tank comprises one or more of a floor and a floating roof of the tank.

16. A cribbing system, comprising:
a first vertical riser;
a second vertical riser;
a first horizontal base span;
a first horizontal cap span;
a first base member having a first vertical base receptacle and a first horizontal base receptacle, wherein the first vertical base receptacle is configured to selectively receive the first vertical riser and the first horizontal base receptacle is configured to selectively receive the first horizontal base span;
a second base member having a second vertical base receptacle and a second horizontal base receptacle, wherein the second vertical base receptacle is configured to selectively receive the second vertical riser and the second horizontal base receptacle is configured to selectively receive the first horizontal base span;
a first cap member having a first vertical cap receptacle and a first horizontal cap receptacle, wherein the first vertical cap receptacle is configured to selectively receive the first vertical riser and the first horizontal cap receptacle is configured to selectively receive the first horizontal cap span;
a second cap member having a second vertical cap receptacle and a second horizontal cap receptacle, wherein the second vertical cap receptacle is configured to selectively receive the second vertical riser and the second horizontal cap receptacle is configured to selectively receive the first horizontal cap span; and
a grounding strap having a first end and a second end, wherein the first end of the grounding strap is electrically coupled to at least one of the first base member, second base member, first cap member, second cap member, first riser, first horizontal base span, and first horizontal cap span, and wherein the first vertical riser, second vertical riser, first horizontal base span, first horizontal cap span, first base member, second base member, first cap member, and second cap member are electrically conductive.

17. The cribbing system of claim 16, further comprising:
a third vertical riser;
a second horizontal base span;
a second horizontal cap span;
a third horizontal base span;
a third horizontal cap span;
a third base member; and
a third cap member,
wherein the first base member further comprises a first angled horizontal base receptacle set at an angle relative to the first horizontal base receptacle and configured to selectively receive the second horizontal base span,
wherein the first cap member further comprises a first angled horizontal cap receptacle set at an angle relative to the first horizontal cap receptacle and configured to selectively receive the second horizontal cap span,
wherein the second base member further comprises a second angled horizontal base receptacle set at an angle relative to the second horizontal base receptacle and configured to selectively receive the third horizontal base span,
wherein the second cap member further comprises a second angled horizontal cap receptacle set at an angle relative to the second horizontal cap receptacle and configured to selectively receive the third horizontal cap span, wherein the third base member has a third vertical base receptacle, a third horizontal base receptacle, and a third angled horizontal base receptacle set at an angle relative to the third horizontal base receptacle, wherein the third vertical base receptacle is configured to selectively receive the third vertical riser, wherein the third horizontal base receptacle is configured to selectively receive the second horizontal base span, and wherein the third angled horizontal base receptacle is configured to selectively receive the third horizontal base span, wherein the third cap member has a third vertical cap receptacle, a third horizontal cap receptacle, and a third angled horizontal cap receptacle set at an angle relative to the third horizontal cap receptacle, wherein the third vertical cap receptacle is configured to selectively receive the third vertical riser, wherein the third horizontal cap receptacle is configured to selectively receive the second horizontal cap span, and wherein the third angled horizontal cap receptacle is configured to selectively receive the third horizontal base span.

18. The cribbing system of claim 16, wherein the first base member comprises a first base roller receptacle positioned generally opposite to the first vertical base receptacle, wherein the first base roller receptacle comprises a first roller transfer unit disposed therein.

19. The cribbing system of claim 18, wherein the second base member comprises a second base roller receptacle positioned generally opposite to the second vertical base receptacle, wherein the second base roller receptacle comprises a second roller transfer unit disposed therein.

20. The cribbing system of claim 16, wherein the second end of the grounding strap has a broom-like structure defined by a braided wire.

* * * * *